United States Patent [19]

Scheurer

[11] Patent Number: 4,635,581

[45] Date of Patent: Jan. 13, 1987

[54] TUBE COVER

[76] Inventor: Robert S. Scheurer, P.O. Box 539, Wichita Falls, Tex. 76307

[21] Appl. No.: 702,702

[22] Filed: Feb. 15, 1985

[51] Int. Cl.[4] ..... B63B 7/08

[52] U.S. Cl. ..... 114/346; 114/345; 441/67

[58] Field of Search ..... 114/345, 346, 242, 253; 441/81, 83, 88, 102–119, 40, 66, 67, 131; 24/265 AL, 115 K, 145, 141; 224/184, 214, 160, 161, 223, 250, 253, 255; 16/DIG. 24, 126, 119; 280/12 B; 272/18; 244/127, 145

[56] References Cited

U.S. PATENT DOCUMENTS

| | | | |
|---|---|---|---|
| 1,677,083 | 7/1928 | Heminger | 441/88 |
| 1,773,932 | 8/1930 | Ayvad | 441/113 |
| 2,405,484 | 8/1946 | Bailhe | 441/127 |
| 2,527,972 | 10/1950 | Touty | 244/151 R |
| 2,876,467 | 3/1959 | Lund | 441/40 |
| 3,512,196 | 5/1970 | Carroll et al. | 441/116 |
| 3,871,042 | 3/1975 | Farmer | 114/346 |
| 4,451,239 | 5/1984 | Hoenstine et al. | 441/67 |

*Primary Examiner*—Trygve M. Blix
*Assistant Examiner*—Edwin L. Swinehart
*Attorney, Agent, or Firm*—James C. Wray

[57] ABSTRACT

A tube cover has top and bottom flat portions stitched together along mutual peripheral edges, and a hitch which consists of a plurality of crossing straps that are interconnected by stitching, and a D-ring attached to one of the straps.

1 Claim, 10 Drawing Figures

FIG. 4
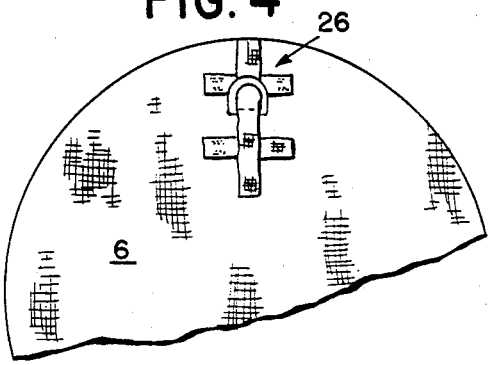
FIG. 6
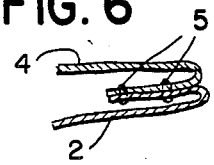
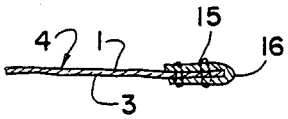
FIG. 8
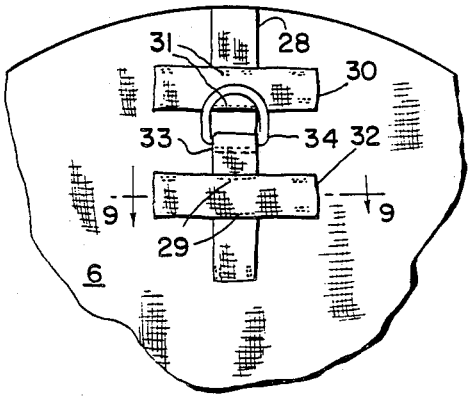
FIG. 7
FIG. 7a
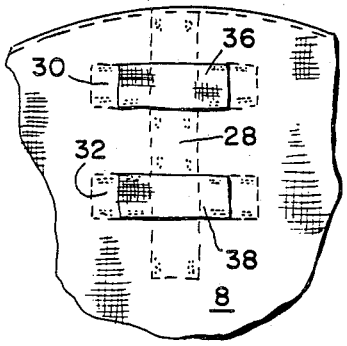
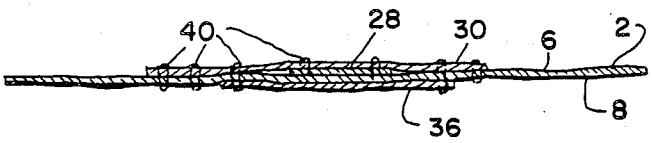
FIG. 9

TUBE COVER

BACKGROUND OF THE INVENTION

The present invention relates to aquatic sport and more particularly to a buoyant raft which is towed behind a motor boat.

It is well known to tow an inner tube from an automobile tire behind a motor boat with a tow rope while a rider sits in the circular middle space in the inner tube.

On larger inner tubes, a rider has a tendency to fall through the center space or has to make an effort to prevent this from occurring.

It is known in the art to provide inner tubes with covers, thereby providing a bottom which prevents the rider from slipping through the center space.

One such apparatus is shown in U.S. Pat. No. 2,683,270 which shows a flat bottom strapped to an inner tube.

U.S. Pat. No. 4,451,239 shows an apparatus consisting of an inner tube, a cover, and a tow strap. The apparatus has several deficiencies, particularly in the tow strap which can easily become twisted and knotted in such a way that it is impossible to untie a tow rope. Also, the cover consists of a single unit which because of the annular upper portion is difficult to manufacture.

Prior art hitches used for attaching tow ropes have proven to be totally inadequate. In particular, no hitch has heretofore been devised which will allow towing in either of two opposite directions. While ordinarily a tow rope is attached to the front as shown in U.S. Pat. No. 4,451,239, it may be desirable to attach the tow rope at the front and pull the apparatus from the rear, by allowing the tow rope to pass under the apparatus. No prior art hitch or strap allows for bi-directional towing.

SUMMARY OF THE INVENTION

The applicant has devised a cover that can be used in connection with any toroidially shaped buoyancy member, such as an inner tube which overcomes the many deficiencies associated with the prior art.

To reduce manufacturing costs, the applicant has provided a two piece construction for the cover itself, the two pieces consisting of a circular flat bottom member and a circular flat top member, the two members being sewn together along mutual peripheral edges. The top member is provided with a central circular opening and a bridle strap stitched thereto, and the bottom member is provided with a reinforced hitch which consists of a series of straps and a metal D-ring. The top and bottom members together form an enclosure for receiving a toroidially shaped buoyancy member as for instance, an inner tube, while the central circular opening defines a sitting space for a rider.

Since both the top and bottom members are flat, the cover can be easily stored when not in use. The fabric material required for constructing can be any of the synthetic materials known for their strength and flexibility. Nylon fabric is preferable. Also, nylon straps are preferred for the various handles and strap elements which comprise the hitch.

Uniquely, the peripheral edges of the bottom and top members are folded inwardly and then stitched together so that the seam and stitching are not visible from the outside. One possibility for manufacturing the cover would be to sew the top and bottom members together and then turn the cover inside out, thereby placing the seam and stitching on the inside.

The bridle strap is formed from a single length of material having its opposite ends sewn in between the top and bottom members at the peripheral edges. Since the opposite ends are sewn to the edge, a loop is formed which overlies an upper surface of the top member and is sewn thereto. Sewing the strap to the upper surface leaves only a small loop at the end which extends partially over the central circular opening in such a way as to provide a bridle or handle for the rider to hold.

The edge of the central circular opening is provided with a reinforcing rim which consists of a length of fabric material extending peripherally around the edge. The fabric lies partially on the upper surface of the top member and partially on the lower surface of the top member and in effect, wraps around the peripheral edge to form a U-shape in cross-section. The material is then sewn along the peripheral edge to form a strong reinforcement.

An object of the invention is to provide a tube cover which can be fabricated of any dimension sufficient to emcompass a toroidially shaped buoyancy member.

Another object of the invention is to provide a tube cover that is inexpensive to manufacture.

Another object of the invention is to provide a tube cover having a reinforced hitch for attaching a tow rope.

Another object of the invention is to provide an aquatic sport apparatus made of fabric comprising a flat circular bottom member and a flat circular top member overlying the bottom member and having a central circular opening therein, the bottom and top members being stitched together along mutual peripheral edges to form an enclosure for a toriodially shaped buoyance member, the apparatus being provided with a hitch for attaching a tow rope, the hitch comprising an elongated strap bonded at its opposite end portions to a lower surface of the bottom member, first and second transverse straps crossing over the elongated strap in a space relation to each other, and being bonded to the lower surface of the bottom member, first and second inner transverse straps bonded to an upper surface of the bottom member and overlying the first and second transverse straps, and a metal ring disposed between the two transverse straps and being connected to the elongated strap, whereby towing forces are transmitted through the metal ring and elongated strap to the transverse straps.

BRIEF DESCRIPTION OF THE DRAWINGS

FIG. 4 is a partial bottom plan view of the preferred embodiment.

FIG. 6 is a cross-sectional view taken along line 6—6 in FIG. 5.

FIG. 7 is a partial bottom plan view of the preferred embodiment, showing an enlargement of the hitch.

FIG. 7A shows a top plan view of the upper surface of the bottom member.

FIG. 8 is a cross-sectional view taken along line 8—8 in FIG. 5.

FIG. 9 is a cross-sectional view taken along line 9—9 of FIG. 7.

DETAILED DESCRIPTION OF THE DRAWINGS

Figure 1:
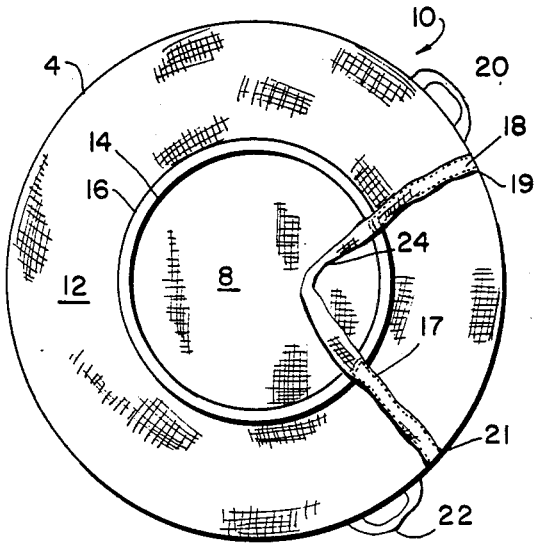
FIG. 1 is a top plan view of the preferred embodiment.
Figure 2:
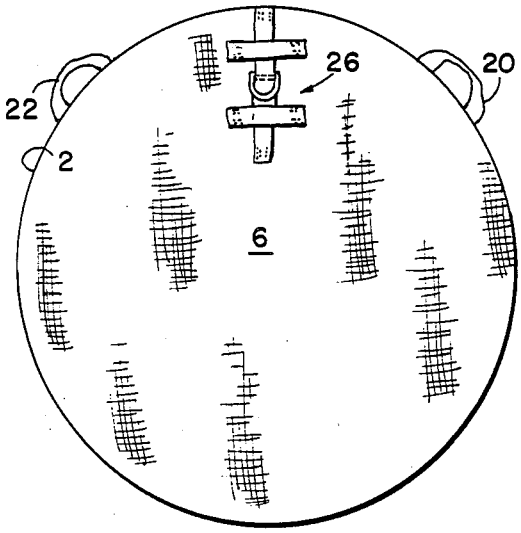
FIG. 2 is a bottom plan view of the preferred embodiment.

Referring to FIGS. 1 and 2, the tube cover of the present invention is shown generally by the number 10. The cover consists primarily of a bottom member 2 and a top member 4 which overlies the bottom member. The top and bottom members are stitched along mutual peripheral edges to form circumferential seam 3.

The top member 4 has a circular opening 14, which has a reinforcing rim 16 circumscribing the edge of the circular opening. The circular opening is located centrally in the top member.

The bottom member 2 has a lower surface 6 and an upper surface 8, the upper surface 8 being visible from above due to the central circular opening 14.

The bridlge strap 18 has opposite ends 19 and 21 that are sewn between the top and bottom members and the peripheral edges. The bridle strap consists of a length of material that forms a loop due to the fact that the ends are attached as described. Most of the loop overlies the upper surface of the top member and is stitched thereto by means of stitching 17. The stitching 17 preferably extends to the reinforcing rim 16 to provide a double reinforcement of the bridle strap. A portion 24 of the loop extends out over the circular opening 14 and provides a handle or bridle for a rider to hold. In addition, hand grips 20 and 22 may be provided at the periphery. The hand grips are preferably sewn in between the top and bottom members as previously described.

The numeral 12 refers generally to an annular space that exists between the outer peripheral edges of the top and bottom members and the reinforcing rim 14. This space is to be filled with an appropriate toroidially shaped buoyancy member such as an inner tube from an automotible tire.

The hitch 26 is shown generally in FIG. 2.

Figure 3:
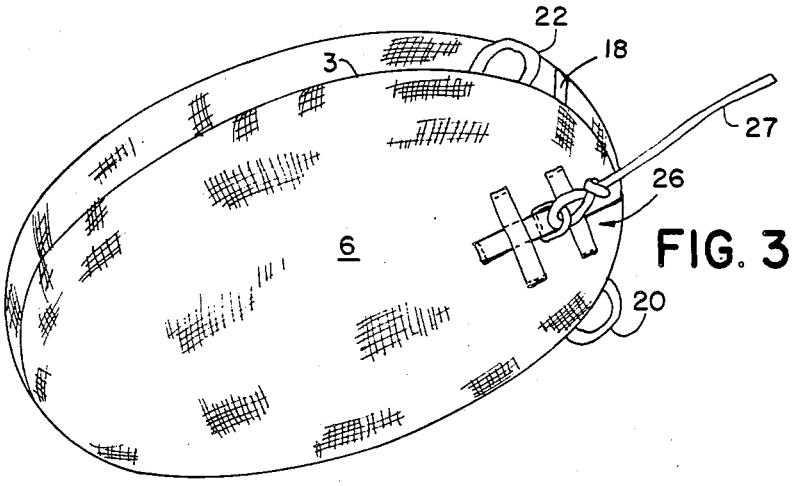
FIG. 3 is a perspective view of the preferred embodiment having a three-dimensional shape due to a buoyancy member received therein.

FIG. 3 shows how the hitch is used for attaching a tow rope 27 which may be attached to a motor boat for towing the apparatus. It should be understood that the two rope forms no part of the applicant's invention.

Figure 5:
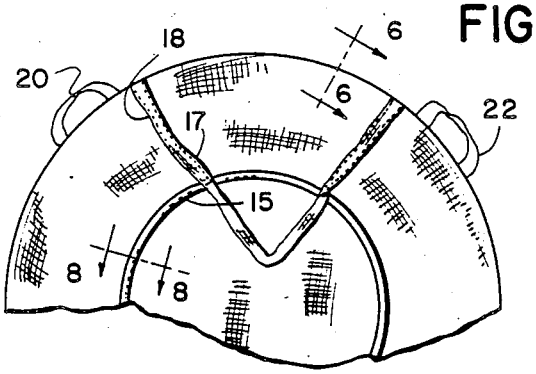
FIG. 5 is a partial top plan view of the preferred embodiment.

FIG. 5 shows that the reinforcing rim 16 is also provided with stitching 15.

The details of the hitch are provided in FIG. 7. The hitch consists primarily of an elongated strap 28 which extends generally in the direction of or the axis of towing. The elongated strap 28 is preferably stitched to the lower surface 6 of the bottom member 2. The stitching is shown generally by the numbers 29 and 31. Additionally, transverse straps 30 and 32 are provided as crossing members which extend in a spaced relationship from one another and lie at right angles to the elongated strap 28. Additional stitching may be provided where portions of the straps 30 and 32 coincide with portions of the strap 28.

It should be definitely understood that there is no stitching of the elongated member 28 at the mid-portion as defined by the space between the transverse straps 30 and 32.

Within this space, a D-ring 34 is provided, which is actually used to connect the tube cover to the tow rope. The D-ring 34 is preferably metal and had a D-shape which allows a flat portion to lie in a transverse direction to the elongated strap 28. The D-ring 34 is secured to the elongated strap 28 by stitching adjacent transverse portions of the strap 28 together with stitching 33 to form a loop through which the flat portion of the D-ring 34 extends.

The hitch is further provided with inner transverse straps 36 and 38 which are stitched to the upper surface 8 of the bottom member 2. The inner transverse straps 36 overly the transverse straps 30 and 32 respectively. It is preferable that the coinciding portions of the straps 28, 30, 32, 36 and 38 are all mutually stitched.

FIG. 9 shows a cross-sectional view of the hitch taken along lines 9—9 of FIG. 7. It can be seen that stitching 40 passes through several layers of the straps and the bottom member 2.

Referring to FIG. 6, a cross-sectional view of the mutual peripheral edges of the top and bottom members are shown. The edges are preferably doubled back and then stitched together with stitching 5, with the stitching being hidden on the inside of the cover. This prevents excessive wear and leads to a more slightly exterior.

FIG. 8 shows a cross-sectional view of the reinforcing rim 16. The reinforcing rim 16 consists of a length of fabric that extends around the edge of the central circular opening 14. In FIG. 8, it can be seen that a portion of the reinforcing rim lies on the upper surface 1 of the top member 4, and a portion lies on the lower surface 3 of the top member. Stitching 15 joins both portions to the edge and holds the rim in a U-shape, enveloping the edge of the circular opening.

It is preferable that the straps are formed of nylon since this material is strong and flexible. The D-ring is preferably formed of metal since the ring is used to take most of the towing force. The various straps are used to transmit the force from the ring through the elongated strap 28 and through to the transverse members 30, 32, 36 and 38.

Other features of the invention will become more apparent from the following claims and drawings:

What I claim is:

1. An aquatic sport apparatus comprising a nylon cover for an inner tube, the cover comprising, a bottom member, a top member overlying the bottom member and having a central opening for receiving an inner tube, the bottom and top members being connected together along mutual peripheral edges to form an enclosure for receiving the inner tube, the enclosure conforming in shape to an outer sidewall of the inner tube, a reinforced hitch connected to a forward portion of the cover, for attaching a tow rope, the hitch comprising an elongated nylon strap having its entire length overlying the cover and having opposite end portions connected to an outer surface of the cover, first and second outer transverse nylon straps connected to the outer surface of the cover and the elongated strap and being spaced and parallel to each other, first and second inner transverse nylon straps connected to an inner surface of the cover and crossing the elongated strap and underlying the first and second outer transverse straps so as to sandwich the portions of the cover and the elongated strap therebetween, and wherein the inner and outer transverse straps are disposed at right angles to the elongated strap, and a metal ring disposed between the two transverse straps and being connected to and carried by the elongated strap, wherein the metal ring is a D-shaped ring with a flat portion thereof lying in a transverse direction to the elongated strap mounted in a loop formed in a medial portion of the elongated strap which extends outwardly from the outer surface of the cover, said D-shaped ring being secured to said elongated strap by stitching transverse portions of the elongated strap together to form a loop through which the flat portion of the D-shaped ring extends to thereby hold the D-shaped ring in place, whereby towing forces are transmitted through the metal ring, the elongated strap the transverse straps and the cover.

* * * * *